US005421394A

United States Patent [19]

Forrest

[11] Patent Number: 5,421,394

[45] Date of Patent: Jun. 6, 1995

[54] SELF-CONTAINED AND REMOVABLE DRAPERY MOUNTING DEVICE

[76] Inventor: Kim Forrest, 1695 Topping Ave., #4D, Bronx, N.Y. 10457

[21] Appl. No.: 52,544

[22] Filed: Apr. 23, 1993

[51] Int. Cl.[6] ..... A47H 7/00

[52] U.S. Cl. ..... 160/350; 211/123; 160/349.2

[58] Field of Search ..... 160/350, 330, 340, 341, 160/349.1, 349.2, 351, 123, 125, 126, 333, 334, 335, 336, 337, 338, 339; 211/123, 206; 135/114; 248/150, 166

[56] References Cited

U.S. PATENT DOCUMENTS

| | | | |
|---|---|---|---|
| 443,133 | 12/1890 | Connelly | 160/350 X |
| 833,557 | 10/1906 | Snyder et al. . | |
| 961,352 | 6/1910 | Walters . | |
| 1,374,026 | 4/1921 | Nelson . | |
| 1,655,515 | 1/1928 | Simpson | 160/334 X |
| 1,756,716 | 3/1928 | Whitney . | |
| 1,980,918 | 11/1934 | Hudspeth | 160/349.2 X |
| 2,104,416 | 1/1938 | De Ment | 160/350 X |
| 2,186,510 | 1/1940 | Walter et al. | 160/350 X |
| 2,910,121 | 10/1959 | Stern et al. | 160/339 X |
| 3,118,363 | 1/1964 | Burgess | 160/330 X |
| 3,144,946 | 8/1964 | Ellis | 211/206 X |
| 3,164,352 | 1/1965 | Weaver | 160/330 X |
| 3,521,758 | 3/1968 | Guilfoyle, Sr. . | |
| 3,541,322 | 3/1969 | Bennett . | |
| 3,952,877 | 4/1976 | Kindl . | |
| 4,139,101 | 2/1979 | Towfigh | 160/350 X |
| 4,158,896 | 6/1979 | Farkas . | |

*Primary Examiner*—David M. Purol
*Attorney, Agent, or Firm*—Kaplan and Mugno

[57] ABSTRACT

A semi-freestanding drapery extension beam comprising (i) two vertical side supports each having a ground-engaging end and a ceiling-engaging end; (ii) a top beam having its ends connected between the ceiling-engaging ends of the side supports; and (iii) a drapery slot extending along the length of said top beam. Additionally, support brackets can be implemented between the top beam and each vertical side support to hold the top beam in position and help it support a vertical load. A sheer clip and tie back hooks can also be implemented to increase the aesthetic beauty of the drapes hung from the inventive beam. Finally, the beam is easily folded for storage or transport. In another embodiment of the present invention, the two vertical side supports are used without a transverse top beam. Again, this allows the use of vertically adjustable tie back hooks without damaging the surrounding walls.

20 Claims, 2 Drawing Sheets

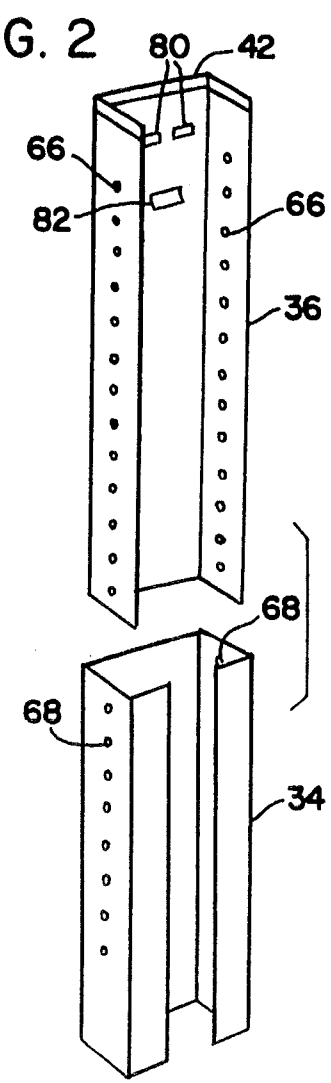
FIG. 2
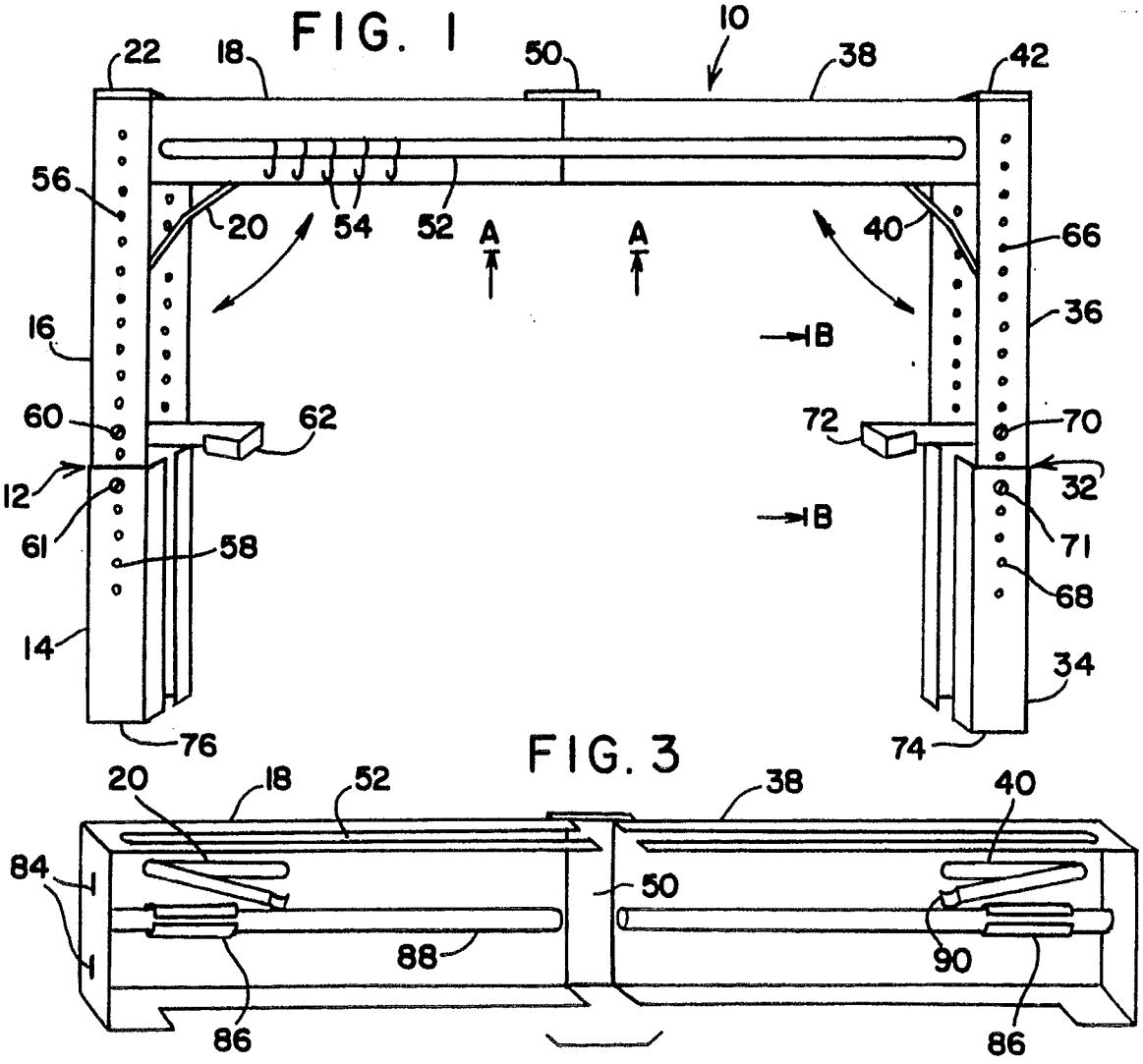
FIG. 1
FIG. 3

SELF-CONTAINED AND REMOVABLE DRAPERY MOUNTING DEVICE

FIELD OF THE INVENTION

This invention is generally directed to a means for mounting drapery. More specifically, this invention pertains to a self-contained drapery mounting apparatus which is easily installed or removed from a window, is adjustable to fit different size windows, and is suitable in homes where the stability of the construction surrounding the window is unsuitable for attachment of drapery hardware or heavier energy-conserving drapes.

BACKGROUND OF THE INVENTION

As is well known, the hanging of drapes over window openings serves several useful purposes. The installation of drapes increases security, reduces energy costs, and serves a decorative function. Regrettably, the hanging of drapes usually requires incorporating cumbersome hardware which leaves permanent markings on adjacent ceilings and walls. Moreover, this required hardware often results in cracking and chipping of the surrounding sheetrock, plaster or concrete due to the constant stress on the hardware caused by the weight of the drapes.

Another disadvantage associated with drapes, particularly for renters who relocate frequently, is the costs associated with them. Since different apartments often have different size windows, the renter is forced either to forego the installation of drapes or to repurchase drapes each time he/she moves.

One type of hanging rod available in the prior art is a single rod inserted between the two side walls associated with the window either by a spring-loaded mechanism or an adaptive bracket on each side wall. While this type of device, as exemplified in Walters U.S. Pat. No. 961,352, Nelson U.S. Pat. No. 1,374,026, and Kindl U.S. Pat. No. 3,952,877, facilitates the installation and removal of drapes from a window frame, it still has many disadvantages including a limited capacity to hold heavier drapes and an inability to allow use of underlying decorative sheers without incorporating a separate rod. Furthermore, if tie backs are desired, a separate hook extension must be installed along the side walls.

Another type of hanging rod available in the prior art is a semi-free standing apparatus as exemplified in the shower curtain mounting apparatus of Farkas U.S. Pat. No. 4,158,896. While this type of device indeed removes some stress from the house structure, it still requires the installing of cumbersome hardware such as fixed flange sockets in the floor and ceiling. This required hardware permanently damages the floor and ceiling. Again, there is neither means to implement underlying decorative sheers or means to tie back the drapes without the installation of separately installed hardware.

It is, therefore, a primary object of the present invention to provide a new and improved drapery mounting device.

It is another object of the present invention to provide a new and improved drapery mounting device which is self-contained and therefore easily transported or stored.

It is still a further object of the present invention to provide a new and improved drapery mounting device which is easier to install or remove compared to prior art devices.

It is yet another object of the present invention to provide a new and improved drapery mounting device which is adjustable to different size windows.

It is an additional object of the present invention to provide a new and improved drapery mounting device which permits easy implementation of decorative underlying sheers without additional hardware being mounted to the surfaces adjacent to the window.

Yet another object of the present invention is to provide a new and improved drapery mounting device which allows easy attachment of a hook extension to pull back the drapes without additional hardware being mounted to the surfaces adjacent to the window.

Still another object of the present invention is to provide a new and improved drapery mounting device which will support drapes comprised of heavy, energy-conserving fabric with minimal stress on the sides or top surfaces adjacent to the window.

Further objects and advantages of the present invention will become apparent as the following description proceeds.

SUMMARY OF THE INVENTION

Briefly stated and in accordance with one embodiment of the present invention, a drapery mounting extension beam is provided which includes two foldable L-shaped beams made of a lightweight metal such as aluminum, wherein each L-shaped beam comprises a vertical support having a ground-engaging end and a ceiling-engaging end and a top beam having a hinged end rotatably coupled to said ceiling-engaging end and a distal free end. The free ends of the top beams are connected to form a three-sided frame and a drapery slot is provided along the lengths of the top beams to hang drapes. A sheer rod can also be provided on the underside of said top beams to allow the hanging of decorative underlying sheers. Moreover, tie back hooks can be coupled to the vertical supports to allow the drapes to be decoratively pulled back. Filigree covers can be attached to the tie back hooks to further enhance the overall look of the drapes.

In another embodiment, typically used where a transverse drapery rod is already installed, the two vertical rods can be implemented without a top beam. This allows the use of vertically adjustable tie back hooks and decorative filigree covers without damaging the walls surrounding the window. The effect of using this simpler and less expensive design is the same as implementing the L-shaped beams with its top beam retracted in the vertical support.

BRIEF DESCRIPTION OF THE DRAWINGS

While the specification concludes with claims particularly pointing out and distinctly claiming the subject matter regarded as the invention herein, it is believed that the present invention will be more readily understood upon consideration of the following description, taken conjunction with the accompanying drawings, wherein:

FIG. 1 is a front perspective view of an extension beam for hanging drapery in accordance with the present invention;

FIG. 2 is an exploded perspective view of the vertical support of the present invention taken in the direction of line B—B of FIG. 1;

FIG. 3 is an exploded perspective view of the top beam of the present invention taken in the direction of line A—A of FIG. 1;

DETAILED DESCRIPTION OF THE DRAWINGS

Figure 7:
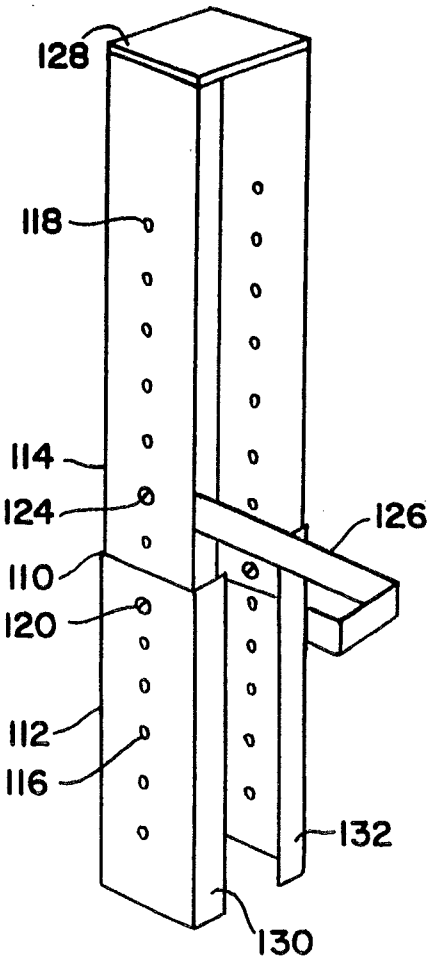
FIG. 7 is a front perspective view of another embodiment of an extension beam for hanging drapery in accordance with the present invention.

Referring first to FIG. 1, an aluminum extension beam for hanging drapery, generally designated 10, is shown. Beam 10 is comprised of a vertical support 12 which itself is comprised of a lower member 14 and an upper member 16. A top beam 18 has a hinged end in common with upper member 16 and is rotatable between a first position wherein top beam 18 is encased within upper member 16 and a second position wherein top beam 18 is substantially perpendicular to upper member 16. Top beam 18 is supported in its second (horizontal) position (as shown in FIG. 1) by means of a support bracket 20 which can be locked between top beam 18 and upper member 16. Support bracket 20 helps distribute the load applied to top beam 18.

Upper member 16 also includes an optional padded cushion 22 which will protect the ceiling on which extension beam 10 is to be implemented. Padded cushion 22 can be made of foam rubber, plastic or the like.

Extension beam 10 also comprises a second vertical support 32 which is comprised of lower member 34 and upper member 36. A top beam 38 has a hinged end in common with upper member 36 and is rotatable between a first position wherein top beam 38 is encased within upper member 36 and a second position wherein top beam 38 is substantially perpendicular to upper member 36. Top beam 38 is supported in its second (horizontal) position (as shown in FIG. 1) by means of a support bracket 40. Upper member 36 has a padded cushion 42 which protects the ceiling when extension beam 10 is installed.

The free end of top beam 18 and the free end of top beam 38 are joined together by an extension bracket 50. Such extension brackets, which allow variation in the distance between the two elements to be joined by the bracket are well known in the art. An elongate drapery slot 52 is formed to extend substantially along the entire length of bracketed top beams 18 and 38. Drapery slot 52 is designed to hold a plurality of drapery hooks 54 upon which the drapes are hung.

Figure 4:
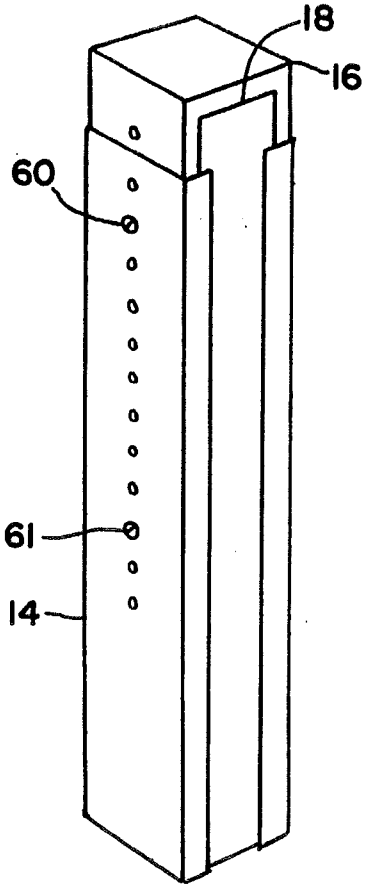
FIG. 4 is a perspective view of the vertical support of the present invention in its fully retracted position.

FIG. 1 illustrates the extension beam of the present invention in its installed position. However, since a three-sided frame structure is difficult to store or transport, extension beam 10 in actuality starts out looking like two of the components of FIG. 4. FIG. 4 will be described in reference to the left side of FIG. 1, but is equally applicable to the right side of FIG. 1. Top beam 18 is folded into its first position within upper member 16. Upper member 16 is telescopically retracted within lower member 14. The result is a compact beam which is easy to store or transport. Screws 60 and 61 are now used to secure extension beam 10 in its retracted position.

To install extension beam 10, vertical supports 12 and 32 are placed opposite each other in an upright position, aligned with a window or wall. Next, the upper members 16 and 36 are pulled out of their respective lower members towards the ceiling. A lever for each support can be used to create a tension securement between the ceiling and the floor or a spring mechanism can be used. While it will help to create a more stable device, it is not essential that the vertical supports be tension mounted.

Upper member 16 includes a vertical track of bores 56 and lower member 14 comprises a corresponding vertical track of bores 58 which will form concentric pairs of bores as upper member 16 is pulled from lower member 14. When the desired height is achieved, screws 61 are inserted in both the front and back (not visible in FIG. 1) concentric pairs of bores to hold the members in their relative position. Other clipping means, such as a nut and bolt, can be inserted through concentric pairs of bores to secure upper member 16 within said lower member 14 at a desired height. Although a separate screw 60 is used to place tie back hook 62 at a different position along vertical support 12, because, in FIG. 1 a different height for tying back the drapes hung from extension beam 10 is desired as compared to the desired height of screws 61, screws 61 can be used to serve the dual purposes of securing lower member 14 and upper member 16, and hold tie back hook 62 in position.

Similarly, upper member 36 includes a vertical track of bores 66 and lower member 34 comprises a corresponding vertical track of bores 68 which will form concentric pairs of bores as upper member 36 is pulled from lower member 34. When the desired height is achieved, screws 71 are inserted in both the front and back (not visible in FIG. 1) concentric pairs of bores to hold the members in their relative position. Although a separate screw 70 is used to place tie back hook 72 at a different position along vertical support 12, because, in FIG. 1 a different height for tying back the drapes hung from extension beam 10 is desired as compared to the desired height of screws 71, screws 71 can be used to serve the dual purposes of securing lower member 34 and upper member 36, and hold tie back hook 72 in position.

It will be noted that one advantage of the separately adjustable vertical supports 12 and 32 is that they allow the user to hang drapes from a top beam which is perfectly horizontal even when the floor is not. For instance, if vertical support 32 has its ground-engaging end 74 one inch lower than ground-engaging end 76 due to an imperfection in the floor, vertical support 32 can simple be adjusted so that it is one inch longer than vertical support 12.

Since the two vertical supports can be placed varying distances apart, it is advantageous if the top beams can accommodate these varying widths without any difficulty. While the extension bracket described above allows for variation, another alternative is to form top beam 38 so that it is telescopically retractable within top beam 18. Again, corresponding bores can be used to insert screws and secure the two top beams to each other when the appropriate width is achieved.

Referring now to FIG. 2, an exploded view of lower member 34 and upper member 36 is illustrated along a view represented by line B—B of FIG. 1. The opposing vertical tracks of bores 66 and 68 as well as cushion padding 42 is visible in this figure. Also visible are two hollowed slots 80 and a hinge hook 82. The purpose of each of these components will become clear in connection with the description of FIG. 3.

Referring now to FIG. 3, an exploded view of top beams 18 and 38 taken in the direction of line A—A is shown. Support bracket 40 is shown in its detached position. Support bracket 40 includes a shaped free end 90 which is designed to snap into and engage bracket hook 82 on upper member 36. A similar mechanism is used to engage support bracket 20. These support brackets secure the top beams in their horizontal position and help distribute the weight of any horizontal load applied to the top beams, for example, the weight of heavy drapes. A pair of open tubular tension clips 86 are provided on the underside of the top beams and engage a tubular sheer rod 88.

It should be noted that sheers are hung by placing them on sheer rod 88 by means of material threaded through the rod. Rod 88 is then engaged with tension clips 86 by snapping rod 88 in place. Furthermore, the drapes can be closed or opened along groove 52 by being walk drawn or by any commonly known cord or lever system.

Drapery grooves 84 on the top beam are accessible through hollowed slots 80 and permit the drapes to be hung entirely around the extension beam 10 so that no part of extension beam 10 is visible when the drapes are hung. It is also possible for drapery grooves 84 to be formed directly on the outside of the upper members, thus eliminated the need for hollowed slots. The drapes to be installed will be hung on drapery pins 54 along drapery slot 52 and around the edges of the top beams to drapery grooves 84.

Figure 5A:
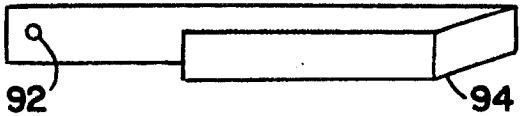
FIGS. 5A, 5B, and 5C are perspective views of illustrative tie back hooks coupled to the vertical supports of the present invention.
Figure 5B:
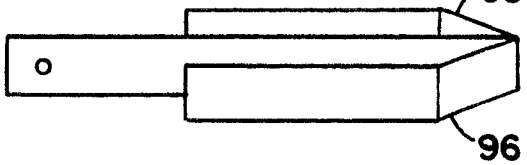
Figure 5C:
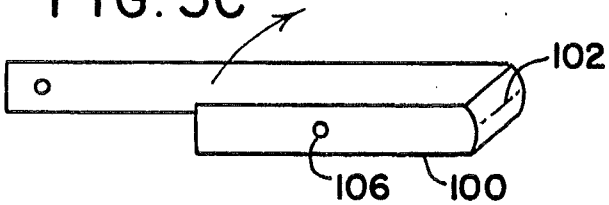

Referring now to FIGS. 5A–C, various designs for tie back hook 62 are shown. In FIG. 5A, a simple design having a single hooked region 94 is illustrated. Bore 92 will be aligned with one of the bores of the vertical support, and a screw will be inserted to attach the tie back hook at a desired height. FIG. 5B illustrates a tie back hook having two hook regions 96 and 98. This design allows its owner to tie back both the drapes and the sheer curtain. Finally, FIG. 5C illustrates a tie back hook having a single hooked region 100 rotatable clockwise around axis 102 as represented by the arrow of FIG. 5C. A rotatable, two-hooked region tie back hook (a combination of FIGS. 5B and 5C) is also possible. These rotatable designs allow different pull-back effects since the angle on which the drapes can be pulled back can be easily varied.

Figure 6:
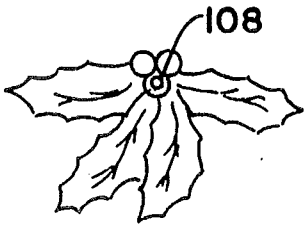
FIG. 6 is a front perspective view of a decorative filigree cover coupled to the tie back hooks of the present invention.

Since the tie back hooks are often unsightly, decorative filigree covers, such as in FIG. 6, can be attached to the tie back hooks to cover them up. The decorative element of FIG. 6 can be attached to the tie back hooks of FIG. 5 by means of inserting and tightening screw 108 through hole 106. Alternatively, the decorative elements can have a loop made of wire or fabric on their back side so that they can be on the hooked region of the tie back hooks. Although not drawn to scale in FIG. 6, the filigree cover should generally be large enough to completely cover the tie back hook on which it is to be connected.

FIG. 7 illustrates an extension beam of the present invention that does not include a top beam. The simpler and less expensive design of FIG. 7 is used when a transverse drapery rod is already installed. Vertical support 110 again includes a lower member 112 and a upper member 114. Lower member 112 includes a vertical series of bores 116 and upper member 114 also includes a vertical series of bores 118. Lower member 112 and upper member 114 are secured in position by screw 120, which is inserted through a coincident pair of bores; a similar screw on the hidden back side of vertical support 110 can be used to provide additional support. A padded cushion 128 is provided on the ceiling-engaging end of vertical support 110 to protect the ceiling from being damaged. A screw 124 is inserted through one of bores 118 to couple tie back hook 126 to upper member 114 at a desired height. Alternatively, tie back hook 126 can be made to be vertically adjustable along vertical support 110 by other means such as a bracket which is slidable along a slot of upper member 114 and which can be tightened anywhere along the slot.

It can also be seen that lower member 112 includes protruding edges 130 and 132 which provide additional stability when vertical support 110 is mounted and also permits easier retraction of upper member 114 into lower member 112 when screw 120 is released. However, because of edge 130 a modified tie back hook or an extension washer (having at least the width of edge 130) is needed to connect tie back hook 126 to the lower member of vertical support 110 since groove 130 will interfere with the extension of the tie back hook beyond the boundary of lower member 112. Alternatively, a slot should be formed in groove 130 to slide a bracket capable of securing tie back hook 126.

It will be apparent from the foregoing description that the present invention provides an adjustable extension beam for hanging drapes comprising: (a) a first foldable L-shaped beam comprising: (i) a first vertical support having a ground-engaging end and a ceiling-engaging end; and (ii) a first top beam having a hinged end rotatably coupled to said ceiling-engaging end of said first vertical support and a distal free end; (b) a second foldable L-shaped beam comprising: (i) a second vertical support having a ground-engaging end and a ceiling-engaging end; and (ii) a second top beam having a hinged end rotatably coupled to said ceiling-engaging end of said second vertical support and a distal free end; (c) means for connecting the free ends of said first and second L-shaped beams; and (d) a drapery slot extending substantially along the entire length of said first and second top beams between the ceiling-engaging end of said first L-shaped beam and-the ceiling-engaging end of said second L-shaped beam. Tie back hooks and decorative filigree covers can be incorporated without the use of any additional hardware being inserted into the foundation of the house in which the drapes are being hung.

While there has been shown and described what are presently considered to be the preferred embodiments of this invention, it will be obvious to those skilled in the art that various changes and modifications may be made without departing from the broader aspects of this invention. For instance, while the extension beam has been described as being preferably comprised of aluminum, many other strong, light-weight materials can be used. Additionally, the apparatus can be built to any scale. Moreover, while the extension beam has been described in connection with. a window, it can also be implemented in a door frame or any other area having a top (ceiling) plane and a floor support. Thus, any reference to "ceiling" or "floor" is for descriptive purposes only and is not intended to limit the uses of the subject invention. It is, therefore, aimed in the appended claims to cover all such changes and modifications as fall within the true spirit and scope of the invention.

What is claimed is:

1. A foldable extension beam for hanging drapery comprising:

a first vertical support having a first upper member telescopically adjustable within a first lower member;

means for securing said first upper member within said first lower member for establishing a desired height of said first vertical support;

a first top beam having a hinged end rotatably coupled to said first upper member and a free end rotatable between a first position wherein said first top beam is substantially encased within said first upper member and a second position wherein said first top beam is substantially perpendicular to said first upper member;

means for fastening said first top beam in a desired position between said first and second positions; and a first elongate drapery slot extending substantially along the length of said first top beam, said first elongate drapery slot capable of engaging a first plurality of drapery hooks.

2. The extension beam of claim 1 further comprising a support bracket coupled between said first top beam and said first upper member to reinforce said first top beam in said second position and redistribute a load applied thereto.

3. The extension beam of claim 1 further comprising a first open tubular tension clip attached on the underside of said first top beam.

4. The extension beam of claim 1 wherein said means for securing the first upper and lower members of said first vertical support comprises:

a first vertical track of bores on said first lower member;

a second vertical track of bores on said first upper member corresponding with said first vertical track of bores enabling a bore of said first track of bores to form a concentric pair with a bore of said second track; and clipping means inserted through said concentric pair to secure said upper member within said lower member at said desired height.

5. The extension beam of claim 3 further comprising a tie back hook coupled to a bore of said vertical tracks.

6. The extension beam of claim 5 further comprising a decorative filigree attachment coupled to and covering said tie back hook.

7. The extension beam of claim 1 further comprising a hollowed slot on an outer edge of said first upper member to allow access to a drapery groove on the hinged end of said first top member.

8. The extension beam of claim 1 further comprising:

a second vertical support having a second upper member telescopically adjustable within a second lower member;

means for securing said second upper member within said second lower member for establishing said desired height of said second vertical support;

a second top beam having a hinged end rotatably coupled to said second upper member and a free end rotatable between a first position wherein said second top beam is substantially encased within said second upper member and a second position wherein said second top beam is substantially perpendicular to said second upper member;

means for fastening said second top beam in a desired position between said first and second positions; and means for connecting the free ends of said first and second top beams.

9. The extension beam of claim 8 wherein said means for connecting the free ends of said first and second top beams is an extension bracket.

10. The extension beam of claim 8 further comprising a second elongate drapery slot extending substantially along the length of said second top beam, said second elongate drapery slot capable of engaging a second plurality of drapery hooks and positioned to form one continuous slot with said first elongate drapery slot when the free ends of the first and second top beams are connected.

11. The extension beam of claim 8 further comprising a second open tubular tension clip attached on the underside of said second top beam.

12. The extension beam of claim 11 further comprising a tubular sheer rod coupled within said first and second tension clips.

13. The extension beam of claim 8 wherein said second top beam is telescopically retractable within said first top beam thereby allowing the distance between the first and second vertical supports to be varied.

14. The extension beam of claim 13 wherein said first and second vertical supports are placed in tension between a ceiling frame and a floor support.

15. An adjustable extension beam for hanging drapes comprising:

(a) a first foldable L-shaped beam comprising:

(i) a first vertical support having a ground-engaging end and a ceiling-engaging end; and (ii) a first top beam having a hinged end rotatably coupled to said ceilings-engaging end of said first vertical support and a distal free end;

(b) a second foldable L-shaped beam comprising:

(i) a second vertical support having a ground-engaging end and a ceiling-engaging end; and (ii) a second top beam having a hinged end rotatably coupled to said ceiling-engaging end of said second vertical support and a distal free end;

(c) means for connecting the free ends of said first and second L-shaped beams; and (d) a drapery slot extending substantially along the entire length of said first and second top beams between the ceiling-engaging end of said first L-shaped beam and the ceiling-engaging end of said second L-shaped beam.

16. The extension beam of claim 15 further comprising:

a first open tubular tension clip attached on the underside of said first top beam;

a second open tubular tension clip attached on the underside of said top second top beam; and a tubular sheer rod coupled within said first and second tension clips.

17. The extension beam of claim 16 further comprising:

a first support bracket between said first vertical support and said first top beam to reinforce the position of said first top beam and to redistribute a load applied thereto; and a second support bracket between said second vertical support and said second top beam to reinforce the position of said second top beam and to redistribute said load applied thereto.

18. The extension beam of claim 17 further comprising:

a first tie back hook coupled to said first vertical support; and a second tie back hook coupled to said second vertical support.

19. The extension beam of claim 18 wherein said second top beam is telescopically retractable within said first top beam thereby allowing the distance between the first and second vertical supports to be varied.

20. The extension beam of claim 19 further comprising:

a first cushion padding on the ceiling-engaging end of said first vertical support; and a second cushion padding on the ceiling-engaging end of said second vertical support.

* * * * *